US007028365B2

(12) United States Patent
Martin et al.

(10) Patent No.: US 7,028,365 B2
(45) Date of Patent: Apr. 18, 2006

(54) PAINT ROLLER SUPPORT

(75) Inventors: Berj A. Martin, Boring, OR (US); Gregg R. Sorenson, West Allis, WI (US)

(73) Assignee: Purdy Corporation, Portland, OR (US)

( * ) Notice: Subject to any disclaimer, the term of this patent is extended or adjusted under 35 U.S.C. 154(b) by 57 days.

(21) Appl. No.: 10/391,496

(22) Filed: Mar. 17, 2003

(65) Prior Publication Data

US 2004/0181893 A1 Sep. 23, 2004

(51) Int. Cl.
*B05C 17/02* (2006.01)

(52) U.S. Cl. ..... 15/230.11; 492/13; 492/19; 492/45; 492/47

(58) Field of Classification Search ..... 15/230.11; 492/13, 16–20, 45, 47; 29/895.21, 895.22, 29/895.23, 898.07
See application file for complete search history.

(56) References Cited

U.S. PATENT DOCUMENTS

| | | | | |
|---|---|---|---|---|
| 2,197,883 | A * | 4/1940 | Sinclair | 29/898.07 |
| 2,520,863 | A | 8/1950 | Thomas et al. | |
| 2,647,276 | A | 8/1953 | Thomas et al. | |
| 2,669,743 | A | 2/1954 | Coughlan | |
| 2,675,605 | A | 4/1954 | Thomas | |
| 2,678,473 | A * | 5/1954 | Butler | 492/45 |
| 2,684,497 | A * | 7/1954 | Graham | 401/197 |
| 2,751,618 | A | 6/1956 | Pruitt | |
| 2,935,757 | A | 5/1960 | Phillips | |
| 2,970,366 | A | 2/1961 | Gill | |
| 2,977,671 | A * | 4/1961 | Wiegand | 492/19 |
| 2,982,010 | A | 5/1961 | Johns | |
| 2,987,746 | A * | 6/1961 | Davis et al. | 15/230.11 |
| 3,060,555 | A | 10/1962 | Kirshenbaum et al. | |
| 3,335,446 | A | 8/1967 | McGinley | |
| 3,447,184 | A | 6/1969 | McGinley | |
| 3,711,887 | A * | 1/1973 | Chapman | 15/230.11 |
| 3,745,624 | A | 7/1973 | Newman | |
| 3,751,748 | A | 8/1973 | Roe et al. | |
| 3,774,278 | A * | 11/1973 | Ashton | 492/19 |
| 3,877,123 | A | 4/1975 | Pharris | |
| 3,986,226 | A | 10/1976 | Roe et al. | |
| 4,196,805 | A * | 4/1980 | Banno | 198/827 |
| 4,209,883 | A | 7/1980 | Hawk | |
| 4,316,301 | A * | 2/1982 | Smith et al. | 15/230.11 |
| 4,361,923 | A | 12/1982 | McKay | |
| 4,402,102 | A | 9/1983 | Al-samman | |
| 4,615,634 | A | 10/1986 | Matsuda | |
| 4,717,276 | A | 1/1988 | O'Brien et al. | |
| 4,897,893 | A | 2/1990 | Barker | |
| 4,937,909 | A | 7/1990 | Georgiou | |
| 4,985,959 | A * | 1/1991 | Lieberman et al. | 15/230.11 |
| 5,210,899 | A | 5/1993 | Goldstein et al. | |

(Continued)

FOREIGN PATENT DOCUMENTS

| | | |
|---|---|---|
| CA | 2 075 575 | 5/1993 |

(Continued)

*Primary Examiner*—Mark Spisich
(74) *Attorney, Agent, or Firm*—Klarquist Sparkman, LLP

(57) ABSTRACT

Embodiments of a paint roller support for rotatably supporting a conventional paint roller cover are disclosed. In one embodiment, a paint roller support comprises a frame having an elongated shaft and at least one hub rotatably coupled to the shaft for supporting a conventional roller cover. A locking spring exerts a retaining force against an inner surface of the roller cover for frictionally retaining the roller cover on the hub while the paint roller support is used to deliver paint to a surface. Embodiments of a method for manufacturing a paint roller support also are disclosed.

41 Claims, 4 Drawing Sheets

U.S. PATENT DOCUMENTS

| | | | | | |
|---|---|---|---|---|---|
| 5,345,648 | A | | 9/1994 | Graves | |
| 5,490,303 | A | * | 2/1996 | Graves | 15/230.11 |
| 5,619,769 | A | | 4/1997 | Hutt | |
| 5,806,131 | A | | 9/1998 | Tennant | |
| 5,903,952 | A | | 5/1999 | Camp, Jr. et al. | |
| 6,101,662 | A | | 8/2000 | Polzin et al. | |
| 6,102,382 | A | | 8/2000 | Labesky | |
| 6,851,155 | B1 | * | 2/2005 | Dove | 15/230.11 |
| 2002/0138935 | A1 | | 10/2002 | Lanz | |

FOREIGN PATENT DOCUMENTS

| | | | |
|---|---|---|---|
| DE | 922 693 | | 7/1949 |
| DE | 2 119 004 | | 10/1972 |
| DE | 3903519 | * | 8/1990 |
| FR | 1.107.072 | | 12/1955 |
| GB | 749 585 | | 5/1956 |
| JP | 62-155966 | * | 7/1987 |
| WO | 00/37184 | * | 6/2000 |

* cited by examiner

PAINT ROLLER SUPPORT

FIELD

The present invention concerns paint roller supports used for applying paint or other surface coatings to a surface.

BACKGROUND

Paint rollers have been used for a long time to apply paint to surfaces. A natural complement to the paint brush, paint rollers apply paint quickly and provide a uniform paint texture that can hide some surface imperfections. Unfortunately, most paint rollers allow the roller cover to slowly slide off of the roller support during use. The painter is then required to periodically push the roller cover back to its desired position. Accordingly, a need exists for a paint roller that retains the roller cover in place under normal conditions of use, yet allows a user to remove the roller cover for cleaning or replacement.

SUMMARY

The present invention is directed toward various combinations of novel and non-obvious aspects of embodiments of a paint roller support and a method for manufacturing a paint roller support, as defined in the claims below.

According to one representative embodiment, a paint roller support comprises a frame having an elongated roller portion and at least one cover support, or hub, rotatably coupled to the roller portion of the frame for supporting a conventional roller cover. A locking spring for retaining the roller cover is rotatably coupled to the roller portion of the frame. The locking spring exerts a retaining force against an inner surface of the roller cover for frictionally retaining the roller cover on the support while the paint roller support is used to deliver paint to a surface. In an illustrated embodiment, the lock spring comprises an open, or split, ring-shaped structure.

In particular embodiments, the roller support has a stationary bearing disposed on the roller portion of the frame and the cover support is rotatably mounted on the bearing. In other embodiments, two spaced apart stationary bearings are disposed on the roller portion of the frame and a cover support is rotatably mounted on each bearing.

According to another representative embodiment, a paint roller support for supporting a roller cover comprises an elongated shaft, a first hub rotatably coupled to the shaft, and a second hub rotatably coupled to the shaft and spaced axially from the first hub. The first and second hubs are mounted for independent rotational movement relative to each other and the shaft. A biasing mechanism, carried by one of the first and second hubs, exerts a radially outwardly directed biasing force against an inside surface of the roller cover sufficient to retain the roller cover on the hubs while the paint roller support is used to apply paint to a surface.

According to yet another representative embodiment, a paint roller support comprises an elongated shaft having a raised surface portion. At least one bearing is disposed on and frictionally engages the raised surface portion such that the bearing is fixed against rotational and axial movement relative to the shaft. A cover support having an outer surface engaging the inside surface of a roller cover is mounted on the bearing for rotational movement relative thereto. In particular embodiments, the raised surface portion is an embossed surface portion formed on the shaft.

According to still another representative embodiment, a paint roller support for supporting a roller cover comprises an elongated shaft and a roller-cover grabbing mechanism rotatably coupled to the shaft. The roller-cover grabbing mechanism is configured to exert a radially outwardly directed retaining force that is sufficient to deform the inside surface of the roller cover, at least while the roller cover is engaged by the roller-cover grabbing mechanism.

According to another representative embodiment, a paint roller support for a roller cover comprises an elongated shaft and at least one cover support rotatably coupled to the shaft. The cover support defines an annular space in which a roller-cover retaining element is disposed. The roller-cover retaining element exerts a retaining force against an inside surface of the roller cover for frictionally retaining the roller cover on the paint roller support during use. The annular space is dimensioned to permit a limited amount of radial and axial movement of the retaining element, and therefore the roller cover retained by the retaining element.

A method for manufacturing a paint roller support, according to one embodiment, comprises forming a raised surface portion on an elongated shaft. A bearing is placed on the raised surface portion so that the bearing frictionally engages the raised surface portion and is retained against rotational and axial movement relative to the shaft. In some embodiments, the raised surface portion comprises an embossed surface portion, which can be formed, for example, by stamping the shaft.

The foregoing and other features and advantages of the invention will become more apparent from the following detailed description of several embodiments, which proceeds with reference to the accompanying figures.

DETAILED DESCRIPTION

Figure 1:
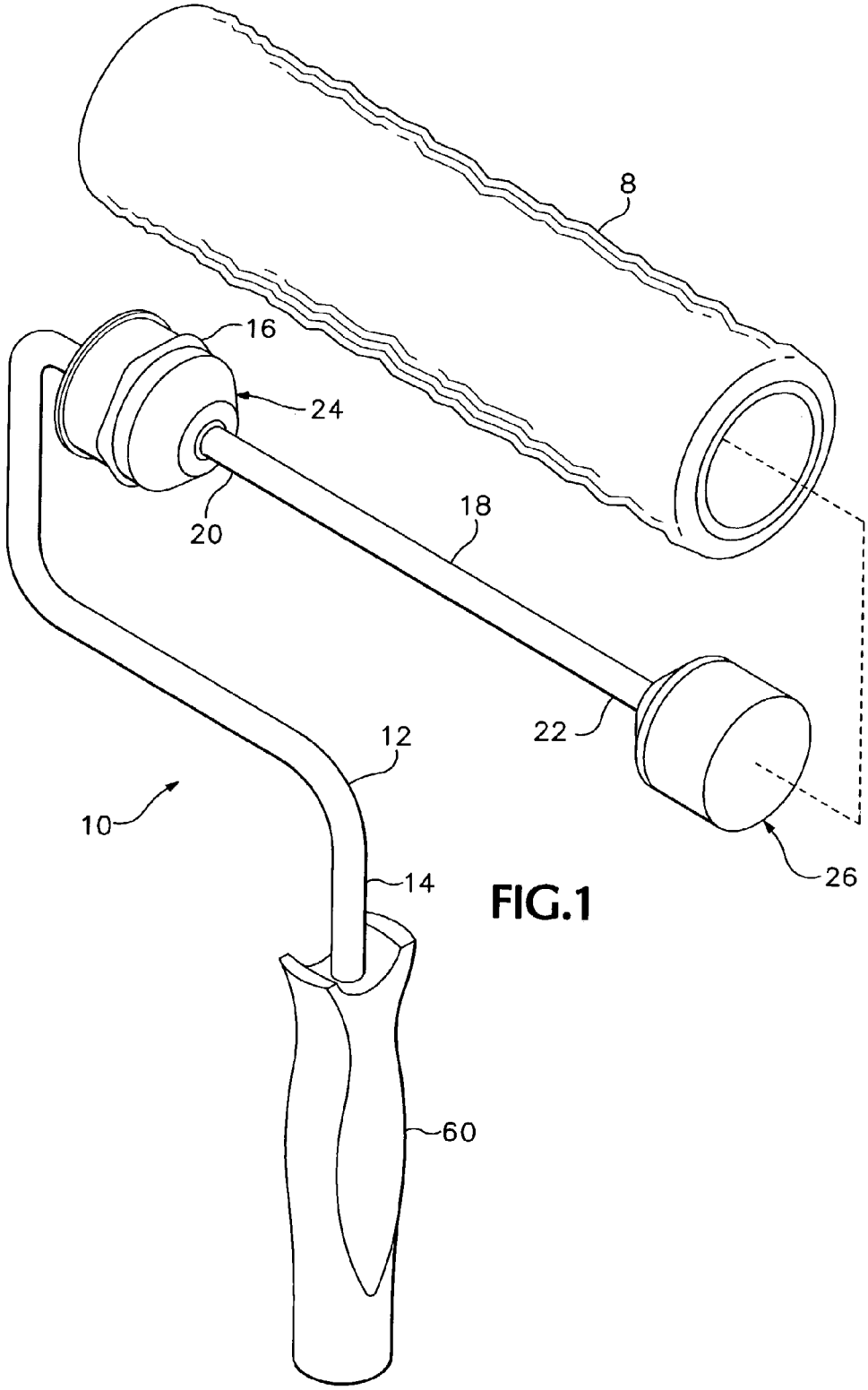
FIG. 1 is a perspective view of a paint roller support according to one embodiment, shown with a paint roller cover removed from the roller support.

FIG. 1 shows a paint roller support 10 according to one embodiment and a conventional paint roller cover 8 shown removed from the roller support 10 for clarity. The roller support 10 in the illustrated configuration includes a frame 12 and a handle 60 coupled to a lower end portion 14 of the frame 12 in a conventional manner. The frame 12 also includes a shaft, or rod, 18 (also referred to herein as the roller portion of the frame 12) having an inboard end portion 20 and an outboard end portion 22. The shaft 18 can be made from any suitable materials, such as aluminum or steel.

In alternative embodiments, the handle 60 is configured to be connectable to an extension rod (not shown). In other embodiments, the handle 60 is removable from the frame 12 and the lower end portion 14 of the frame 12 is configured to be connectable to an extension rod.

An inboard cover support assembly 24 is mounted for rotational movement on the inboard end portion 20 of the shaft 18. An outboard cover support assembly 26 is mounted for rotational movement to the outboard end portion 22 of the shaft 18. In use, the cover support assemblies 24, 26 support the cover 8 and allow the cover 8 to be rolled along a surface (e.g., a wall) for applying paint or other surface coating to the surface.

In particular embodiments, a roller-cover retaining element (also referred to herein as a biasing mechanism, a cover-gripping element and a cover-grabbing mechanism) exerts a radially outwardly directed retaining force against the inside surface of the roller cover 8 to frictionally retain the cover 8 on the cover support assemblies 24, 26 during use. In one specific implementation, as shown in FIG. 1, the roller-cover retaining element is a locking spring 16, which is retained by the inboard cover support assembly 24. The locking spring 16 and other embodiments of a roller-cover retaining element are further described below.

Although the embodiments of the paint roller support disclosed herein are shown as supporting a roller cover for applying paint or other surface coating, it also could be used for rotatably supporting other tubular articles, such as a roller of paper in a paper dispenser.

In the illustrated embodiment, the cover support assemblies 24, 26 are mounted for independent rotational movement; that is, each assembly 24, 26 can freely rotate with respect to each other when the roller cover 8 is not on the roller support 10. In other embodiments, however, the cover support assemblies 24, 26 can be interconnected to each other. For example, the cover support assemblies 24, 26 can be interconnected to each other with spring wires, such as used in a conventional cage assembly.

In particular embodiments, such as shown in FIG. 1, the cover support assemblies 24, 26 desirably are longitudinally spaced from each other to support the opposite end portions of the cover 8 to ensure the cover 8 is properly balanced during use. However, in other embodiments, the cover support assemblies 24, 26 can be spaced inwardly of the inboard and outboard end portions of the shaft 18, closer to the center of the shaft 18. In still other embodiments, the roller support 10 can have a single rotatable cover support or more than two cover supports. Where a single cover support is used, the cover support desirably is much longer than the illustrated cover supports 24, 26 and is positioned at the center of the shaft 18 to balance the cover 8.

Figure 2:
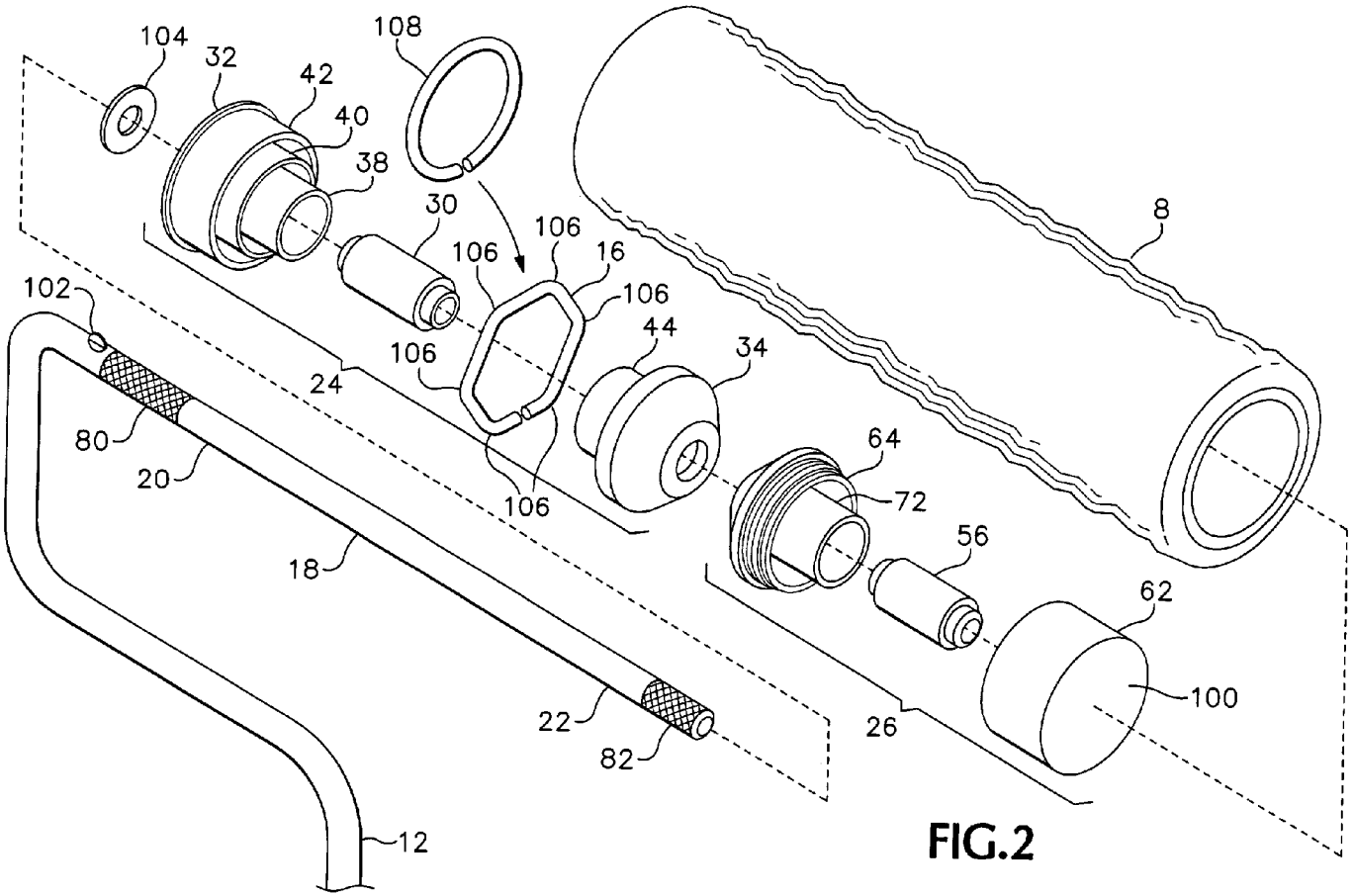
FIG. 2 is an exploded perspective view of the paint roller support and the roller cover of FIG. 1.
Figure 3:
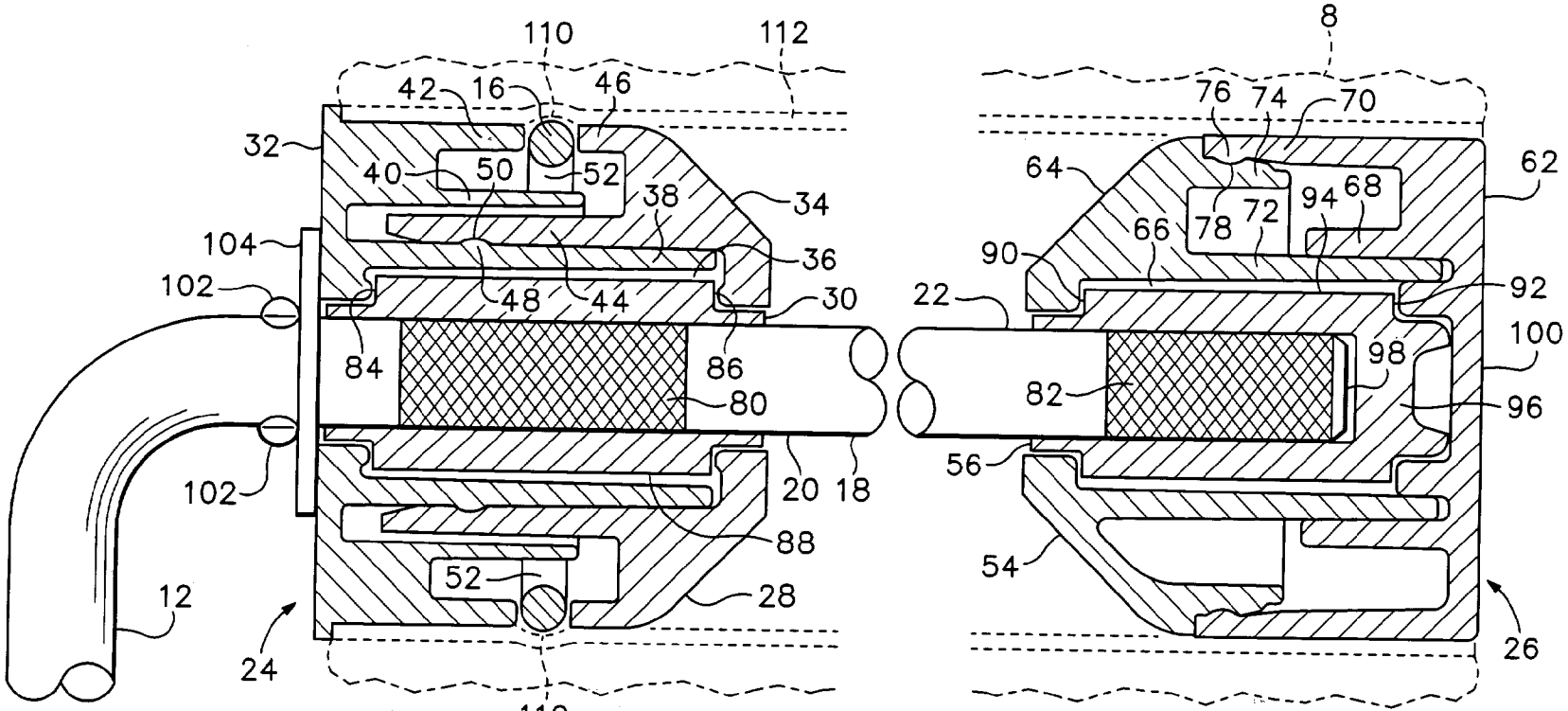
FIG. 3 is a cross-sectional view of the roller support of FIG. 1 taken along a longitudinal axis of the roller support, shown with a roller cover installed on the roller support.

Referring to FIGS. 2 and 3, there are shown an exploded view and a cross-sectional view, respectively, of the roller support 10 shown in FIG. 1. In the illustrated embodiment, the inboard cover support assembly 24 comprises a rotatable inboard cover support 28 (also referred to herein as the outboard hub or end cap) (FIG. 3) and an inboard bearing 30. Cover support 28 is freely rotatable with respect to bearing 30 and shaft 18. The cover support 28 in the illustrated configuration comprises a first portion 32 and a second portion 34, which, when assembled, form a bearing-receiving space 36 in which the bearing 30 is disposed (FIG. 3).

As shown in FIGS. 2 and 3, the first portion 32 has a first longitudinally extending sleeve 38, a second longitudinally extending sleeve 40 spaced radially outwardly from the first sleeve 38, and an annular flange 42 spaced radially outwardly from the second sleeve 40. The second portion 34 has a longitudinally extending sleeve 44 and an annular flange 46 spaced radially outwardly from the sleeve 44. When assembled, sleeve 44 of the second portion 34 extends in an overlapping relationship with sleeve 38 of the first portion 32. In particular embodiments, as shown in FIG. 3, the outer surface of the first sleeve 38 is formed with an annular projection 48 that mates with a corresponding annular indention 50 in the adjacent inner surface of sleeve 44 to form a "snap fit" connection to secure the first and second portions 32, 34.

As best shown in FIG. 3, a receiving space 52 for retaining the locking spring 16 is defined by annular flanges 42, 44 and sleeve 40. In the illustrated embodiment, the width of the receiving space 52 in the axial direction (i.e., the distance between the adjacent ends of flanges 42 and 46) is greater than the width of the locking spring 16 to permit a limited amount of axial movement of the locking spring 16 within the receiving space during use. In addition, the receiving space 52 desirably is dimensioned with sufficient clearance in the radial direction between flanges 42, 46 and sleeve 40 to permit compression of the locking spring 16 when the cover 8 is pressed over the spring and to permit a limited amount of radial movement of the compressed spring. This allows the locking spring 16 to "float" within the receiving space 52 during use. In this manner, the locking spring 16 resists forces acting to remove the roller cover 8 from the support 10, while permitting a limited amount of radial and axial movement of the roller cover 8 to reduce some of the radial and axial forces transmitted to the cover support assemblies 24, 26 during use.

In alternative embodiments, the receiving space 52 can be dimensioned such that the flanges 42, 46 abut the locking spring 16, thereby preventing any axial movement of the locking spring. In other embodiments, the receiving space 52 can be dimensioned to prevent radial movement of the locking spring 16 or both radial and axial movement.

The outboard cover support assembly 26 comprises a rotatable outboard cover support 54 (also referred to herein as the inboard hub or end cap) and an outboard bearing 56 (FIG. 3). Cover support 54 is freely rotatable with respect to bearing 56 and shaft 18. The cover support 54 comprises a first portion 62 and a second portion 64, which, when assembled, form a bearing-receiving space 66 in which the outboard bearing 56 is disposed (FIG. 3). The first portion 62 has longitudinally extending sleeves 68 and 70, which extend in an overlapping relationship with sleeves 72 and 74, respectively, of the second portion 64. Sleeve 70 is formed with an annular projection 76 that forms a snap fit connection with a corresponding indention 78 formed in sleeve 74 to secure the first and second portions 62, 64.

The inboard and outboard bearings 30, 56 desirably are retained against rotational and axial movement relative to the shaft 18. In particular embodiments, the bearings 30, 56 form a tight frictional fit with the surface of the shaft 18 to retain the bearings against rotational and axial movement. Desirably, the shaft 18 has raised surface portions, such as the illustrated inboard and outboard embossed surface portions 80 and 82, respectively, formed on the shaft 18, for frictionally engaging the inner surfaces of the bearings 30, 56. The embossed surface portions 80, 82 can be formed in any suitable manner, such as by stamping the shaft with a die.

In particular embodiments, the outboard embossed surface portion 82 is less aggressive than the inboard embossed surface portion 80; that is, the outer diameter of the outboard embossed surface portion 82 is less than the outer diameter of the inboard embossed surface portion 80. In this manner, when the roller support 10 is assembled, the inboard bearing 30 can be slid over the outboard embossed surface portion 82 without scoring or otherwise damaging the inner surface of the bearing 30.

In alternative embodiments, the inboard and outboard end portions 20, 22, respectively, of shaft 18 are stepped to form raised surface portions for frictionally retaining the bearings 30, 56. In other embodiments, the bearings 30, 56 can be retained against rotational and axial movement by securing the bearings on the shaft with a suitable adhesive. Alternatively, mechanical fasteners can be used to fasten the bearings to the shaft. For example, each bearing can be retained by a set screw extending through the bearing and tightened against the surface of the shaft 18.

In the illustrated embodiment, inboard bearing 30 has radial bearing surfaces 84 and 86, and an axial bearing surface 88 extending between the radial bearing surfaces 84, 86. Outboard bearing 56 is similarly formed with radial bearing surfaces 90 and 92, and an axial bearing surface 94 extending between the radial bearing surfaces 90, 92.

In the illustrated configuration, there are gaps between bearing surfaces 84, 86, and 88 and the adjacent inside surfaces of cover support 28. Likewise, there are gaps between bearing surfaces 90, 92, and 94 and the adjacent surfaces of cover support 54. In this manner, the bearings 30, 56 are loosely received in their respective bearing-receiving spaces 36, 66 to permit a limited amount of radial and axial movement of the cover supports 28, 54 relative to the bearings during use. Such movement of the cover supports 28, 54 relative to bearings 30, 56 reduces some of the radial and axial forces transmitted to the bearings during use. However, in other embodiments, the bearing-receiving spaces 36, 66 can be dimensioned to prevent radial and/or axial movement of the bearings 30, 56.

The outboard bearing 56 desirably has a closed end wall 96 adjacent the outboard end 98 of shaft 18. Advantageously, end wall 96 ensures that bearing 56 is retained against axial movement in the inboard direction in the event excessive axial forces are applied to the outboard end of the roller cover 8. Such excessive forces can occur, for example, if a user misuses the roller cover 8 as a hammer to drive protruding nails into a surface being painted. In alternative embodiments, bearing 56 can be formed with an internal bore that extends completely through the bearing.

Cover support 54 desirably has a closed end wall 100 adjacent end wall 96 of the bearing 56. End wall 100 serves to isolate the shaft 18 and bearing 56 from excessive axial forces applied to the outboard end of the roller support 10.

In particular embodiments, swedges 102 are formed on opposite sides of the inboard end portion 20 of shaft 18 and a washer 104 is disposed on the shaft between swedges 102 and the inboard cover support assembly 24, as known in the art. Swedges 102 and washer 104 ensure that cover support assembly 24 is retained against axial movement in the inboard direction in the event that excessive axial forces are applied to the cover support assembly 24.

As best shown in FIG. 2, the locking spring 16 is an open, or split, band, or ring-shaped structure, configured to exert a radially outwardly directed spring force, in a manner similar to a conventional snap ring. As illustrated in FIG. 3, the spring force exerted by the locking spring 16 against the inside surface 112 of the roller cover 8 desirably is sufficient to deform the inner surface of the roller cover 8, thereby creating detents, or indentations, 110 where the spring 16 contacts the inner surface 112 of the roller cover 8. As best shown in FIG. 2, the illustrated locking spring 16 is generally hexagonal in shape, with corners, or vertices, 106 that contact and deform the inside surface 112 of the roller cover 8. In any event, by deforming the inner surface 112 of the roller cover 8, the locking spring 16 prevents the roller cover 8 from slipping off the roller support 10 under normal conditions of use, yet permits a user to remove the roller cover 8 for cleaning or replacement.

In particular embodiments, the locking spring 16 is made from 0.156 inch diameter stainless steel wire, although other dimensions or materials can be used to form the locking spring. Although the illustrated locking spring 16 is hexagonal in shape, this is not a requirement. Accordingly, the locking spring can be any of various shapes. For example, the locking spring can be a polygon having any number of sides. Alternatively, a generally circular locking spring 108 can be used (FIG. 2).

The cover supports 28, 54 and bearings 30, 56 can be made from any suitable materials. In working embodiments, for example, bearings 30, 56 are made of a low-friction material, such as nylon. The cover supports 28, 54 are molded from a suitable polymeric material, such as an acetal resin (e.g., Delrin®).

Having described the structure of the paint roller support 10, a method for manufacturing the roller support will now be described. In one specific approach, the roller support 10 is made by first cutting to length a metal rod (e.g., aluminum or steel) of proper gauge and then bending the rod to create the shape of the frame 12 (as shown in FIGS. 1 and 2). The shaft 18 is then stamped to form the inboard and outboard embossed surface portions 80, 82. As noted above, the inboard embossed portion 80 desirably receives a more aggressive stamp to create an embossed surface area that has a larger diameter than that of the outer embossed surface area. Also, the shaft 18 is crimped to form swedges 102. The order of bending the frame 12, embossing the shaft 18, and crimping the shaft 18 is not critical.

The inboard cover support assembly 24 is assembled by placing bearing 30 between the first and second portions 32, 34 and then pressing together the first and second portions 32, 34. The outboard cover support assembly 26 is assembled in a similar manner. After the washer 104 is slid onto the shaft 18, the inboard cover support assembly 24 is pressed onto the shaft 18 until bearing 30 is positioned over embossed portion 80, as shown in FIG. 3. Finally, the outboard cover support assembly 26 is pressed onto the outboard end portion 22 of the shaft 18.

Figure 4:
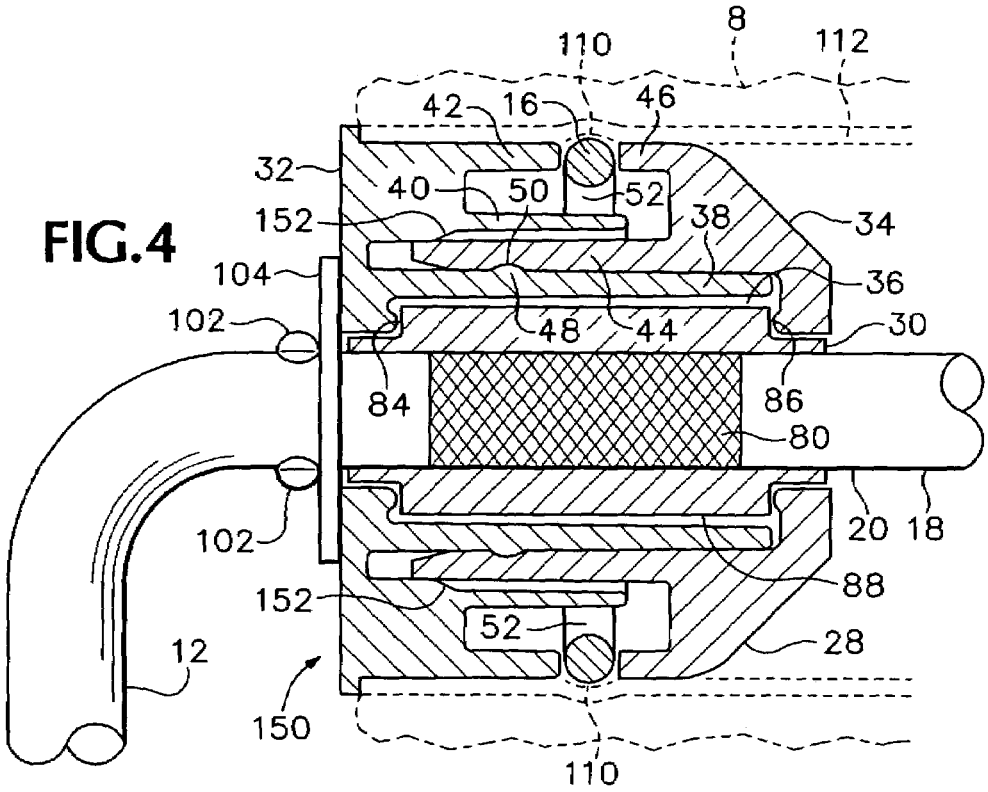
FIG. 4 is a cross-sectional view of an inboard cover support assembly of a roller support according to another embodiment.

FIG. 4 illustrates an inboard cover support assembly 150 according to another embodiment. This embodiment shares many similarities with the inboard cover support assembly 24 of FIG. 3. Hence, components in FIG. 4 that are identical to corresponding components in FIG. 3 have the same respective reference numerals and are not described further. In this embodiment, first portion 32 is formed with a stepped surface 152 that contacts the end portion of sleeve 44 of the second portion 34. The stepped surface 152 maintains the sleeve 44 in mating contact with sleeve 38 to better resist forces acting to separate the first and second portions 32, 34 of the cover support 28.

Figure 5:
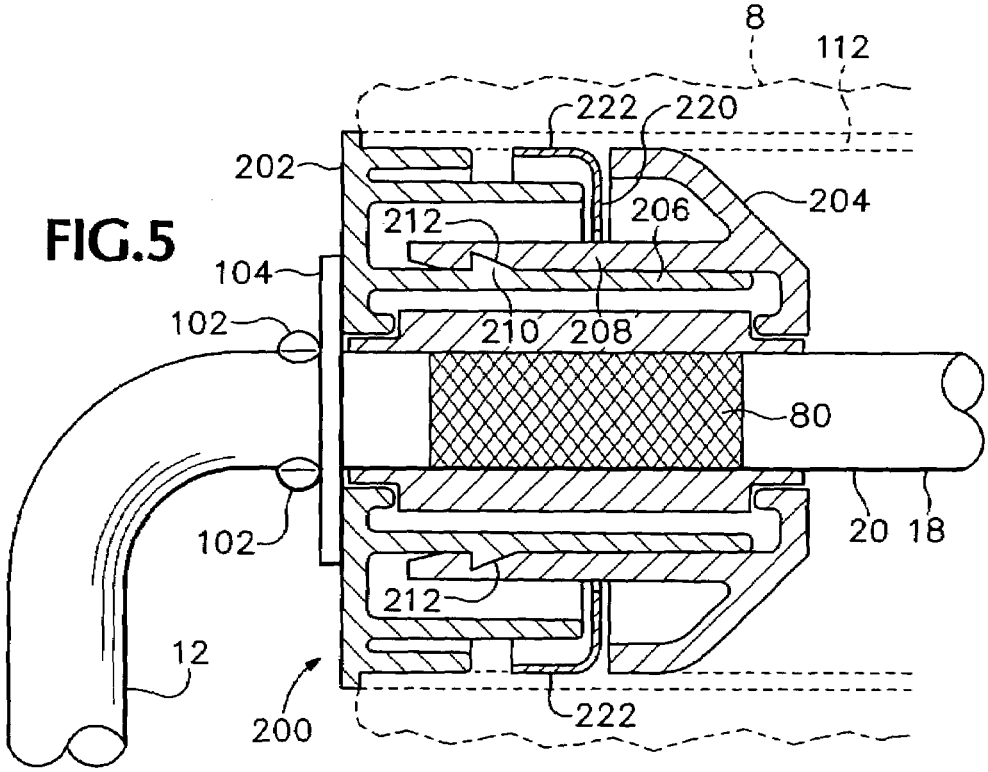
FIG. 5 is a cross-sectional view of an inboard cover support assembly of a roller support according to another embodiment.

FIG. 5 illustrates an inboard cover support assembly 200 according to yet another embodiment. Components in FIG. 5 that are identical to corresponding components in FIG. 3 have the same respective reference numerals and are not described further. Assembly 200 includes first and second hub portions 202 and 204, respectively. The first portion 202 has a sleeve 206 extending in an overlapping relationship with a sleeve 208 of the second portion 204. Sleeve 206 is formed with annular projection 210 that forms a snap fit connection with a corresponding annular recess 212 formed in sleeve 208. The cross-section of the projection 210 in this configuration has a vertical inboard surface. As be appreciated from FIG. 5, the projection 210, in cooperation with recess 212, resists forces acting to separate first and second portions 202, 204. A similar snap fit configuration can be used with the outboard cover support 54 of FIGS. 1–3.

In the embodiment of FIG. 5, a generally cup-shaped biasing member 220 is retained between first and second hub portions 202, 204. Biasing member 220 has a continuous annular flange 220 that frictionally retains the inside surface 112 of the roller cover 8.

In another embodiment, a roller support can have rotatable cover supports, such as cover supports 28, 54 of FIGS. 1–3, that are rotatably mounted to the shaft without any bearings. In yet another embodiment, each cover support can have a one-piece, unitary construction, instead of the two-piece construction shown in FIGS. 1–5.

The present invention has been shown in the described embodiments for illustrative purposes only. The present invention may be subject to many modifications and changes without departing from the spirit or essential characteristics thereof. We therefore claim as our invention all such modifications as come within the spirit and scope of the following claims.

We claim:

1. A paint roller support comprising:

a frame having an elongated roller portion;

at least one cover support for supporting a roller cover, the cover support being rotatably coupled to the roller portion of the frame; and a locking spring rotatably coupled to the roller portion, the locking spring comprising a generally ring-shaped, open band exerting a retaining force against an inner surface of the roller cover for frictionally retaining the roller cover on the support during use;

wherein the locking spring is in the form of a polygon having a plurality of generally straight sides with vertices between adjacent sides contacting the inner surface of the roller cover.

2. The paint roller support of claim 1, wherein the locking spring is hexagonal.

3. The paint roller support of claim 1, wherein the retaining force exerted by the locking spring deforms the inner surface of the roller cover.

4. The paint roller support of claim 1, further comprising a bearing disposed on the roller portion of the frame, the bearing having an inner surface forming a frictional fit with the roller portion of the frame, the frictional fit preventing rotation of the bearing relative to the frame, the cover support being supported by the bearing for rotational movement relative thereto.

5. The paint roller support of claim 4, wherein the roller portion of the frame has an embossed surface portion frictionally engaging the inner surface of the bearing.

6. The paint roller support of claim 4, wherein:

the bearing has radial bearing surfaces and an axial bearing surface extending between the radial bearing surfaces; and the cover support has an axially extending bearing-receiving space for receiving the bearing, the bearing-receiving space having radial end surfaces adjacent respective radial bearing surfaces of the bearing and an axially extending inner surface co-axially disposed with respect to the axial bearing surface of the bearing.

7. The paint roller support of claim 6, wherein the bearing-receiving space is dimensioned to loosely receive the bearing to permit axial and radial movement of the cover support relative to the bearing.

8. The paint roller support of claim 1, wherein:

the roller portion of the frame includes an inboard end portion and an outboard end portion;

the at least one cover support comprises an inboard cover support and an outboard cover support; and the paint roller support comprises an inboard bearing disposed on the inboard end portion of the roller portion and an outboard bearing disposed on the outboard end portion, the inboard and outboard cover supports being rotatably supported on the inboard and outboard bearings, respectively.

9. The paint roller support of claim 8, wherein the roller portion of the frame has an outboard end, and the outboard bearing is formed with an opening for receiving the roller portion and a closed end wall positioned adjacent the outboard end of the roller portion.

10. The paint roller support of claim 8, wherein the roller portion of the frame has an outboard end and the outboard cover support has a closed end wall positioned adjacent the outboard end.

11. The paint roller support of claim 8, wherein:

the roller portion of the frame has an outboard end;

the outboard bearing is formed with an opening for receiving the roller portion and a closed end wall positioned adjacent the outboard end of the roller portion; and the outboard cover support has a closed end wall positioned adjacent the end wall of the outboard bearing.

12. The paint roller support of claim 8, wherein the inboard end portion has a diameter that is greater than the diameter of the outboard end portion.

13. The paint roller support of claim 8, further comprising:

a swedge formed on the roller portion of the frame positioned inboard of the inboard cover support; and a washer disposed on the roller portion the frame and positioned between the swedge and the inboard cover support.

14. The paint roller support of claim 1, wherein the cover support has a locking-spring receiving space, the locking spring being retained in the receiving space.

15. The paint roller support of claim 14, wherein the receiving space is dimensioned to loosely receive the locking spring to permit axial and radial movement of the locking spring while the roller support is used to apply paint to a surface.

16. The paint roller support of claim 1, wherein the cover support comprises a first portion having a longitudinally extending sleeve and a second portion having a longitudinally extending sleeve at least partially overlapping the sleeve of the first portion.

17. The paint roller support of claim 16, wherein the sleeves form a snap fit connection with each other.

18. The paint roller support of claim 16, wherein the locking spring is interposed between the first and second portions of the cover support such that the locking spring is retained longitudinally with respect to the cover support.

19. A paint roller support for supporting a roller cover, comprising:

an elongated shaft;

a first bearing disposed on the shaft;

a second bearing disposed on the shaft and spaced axially from the first bearing;

a first hub rotatably coupled to the first bearing, the first bearing being loosely received in a bearing-receiving space in the first hub to permit limited axial and radial movement of the first hub relative to the first bearing;

a second hub rotatably coupled to the second bearing and spaced axially from the first hub, the second bearing being loosely received in a bearing-receiving space in the second hub to permit limited axial and radial movement of the second hub relative to the second bearing, the first and second hubs being mounted for independent rotational movement relative to each other and the shaft;

the first hub comprises first and second hub portions, the first hub portion having a first longitudinally extending sleeve and the second hub portion having a second longitudinally extending sleeve at least partially overlapping the first sleeve, the first and second hub portions defining an annular space;

a biasing mechanism disposed in the annular space, the biasing mechanism configured to exert a radially outwardly directed biasing force against an inside surface of the roller cover sufficient to retain the roller cover on the hubs while in use yet allowing removal of the cover when desired.

20. The paint roller support of claim 19, wherein the biasing mechanism is a generally ring-shaped structure.

21. The paint roller support of claim 19, wherein the biasing mechanism is a generally cup-shaped ring having a continuous annular flange exerting a biasing force against the inner surface of the roller cover.

22. The paint roller support of claim 19, wherein:

the first hub substantially encloses the first bearing, and the first bearing has first and second radial bearing surfaces that can contact adjacent radial surfaces of the first hub, the first bearing also comprising a central portion having a first diameter and opposite end portions having a second diameter that is less than the first diameter, the first hub having circumferentially extending, first and second inner surfaces, each inner surface extending generally co-axially with respect to an end portion of the first bearing;

the second hub substantially encloses the second bearing, and the second bearing has first and second radial bearing surfaces that can contact adjacent radial surfaces of the second hub, the second bearing also comprising a central portion having a first diameter and opposite end portions having a second diameter that is less than the first diameter, the second hub having circumferentially extending, first and second inner surfaces, each inner surface extending generally co-axially with respect to an end portion of the second bearing.

23. The paint roller support of claim 19, wherein:

the shaft comprises first and second, spaced apart raised surface portions; and the first bearing frictionally engages the first raised surface portion and is fixed against rotational movement relative thereto, and the second bearing frictionally engages the second raised surface portion and is fixed against rotational movement relative thereto.

24. The paint roller support of claim 19, wherein the annular space is dimensioned to retain the biasing mechanism therein while permitting a limited amount of axial and radial movement of the biasing mechanism relative to the first hub.

25. A paint roller comprising:

an elongated shaft, the shaft having a raised surface portion;

at least one bearing frictionally engaging the raised surface portion, the bearing being fixed against rotational movement relative to the shaft;

a roller cover support supported on the bearing for rotational movement relative thereto, the roller cover support defining a bearing receiving space substantially enclosing the bearing and configured to prevent removal of the roller cover support from the bearing in the inboard and outboard directions, wherein the roller cover support comprises first and second interconnected hub portions defining the bearing receiving space, the first hub portion having an inner surface juxtaposed to a first radial bearing surface of the bearing and the second hub portion having an inner surface juxtaposed to a second radial bearing surface of the bearing; and a paint roller cover for placing on the roller cover support; wherein:

the shaft has inboard and outboard raised surface portions;

the at least one bearing comprises an inboard bearing and an outboard bearing, the inboard and outboard bearings frictionally engaging the inboard and outboard raised surface portions, respectively; and the cover support comprises first and second cover supports rotatably supported on and substantially enclosing the inboard and outboard bearings, respectively.

26. The paint roller support assembly of claim 25, wherein the raised surface portions comprise embossed surface portions.

27. The paint roller support assembly of claim 25 wherein the outboard raised surface portion has a smaller diameter than the inboard raised surface portion.

28. A paint roller comprising:

an elongated shaft, the shaft having a raised surface portion:

at least one bearing frictionally engaging the raised surface portion, the bearing being fixed against rotational movement relative to the shaft;

a roller cover support supported on the bearing for rotational movement relative thereto, the roller cover support defining a bearing receiving space substantially enclosing the bearing and configured to prevent removal of the roller cover support from the bearing in the inboard and outboard directions, wherein the roller cover support comprises first and second interconnected hub portions defining the bearing receiving space, the first hub portion having an inner surface juxtaposed to a first radial bearing surface of the bearing and the second hub portion having an inner surface juxtaposed to a second radial bearing surface of the bearing;

a paint roller cover for placing on the roller cover support; and wherein:

the shaft has an outboard end; and the bearing is formed with an axial opening for receiving the shaft and a closed end wall positioned adjacent the outboard end of the shaft.

29. The paint roller support assembly of claim 28, wherein the cover support is formed with a closed end wall positioned adjacent the end wall of the bearing.

30. A paint roller comprising:

an elongated shaft, the shaft having a raised surface portion;

at least one bearing frictionally engaging the raised surface portion, the bearing being fixed against rotational movement relative to the shaft;

a roller cover support supported on the bearing for rotational movement relative thereto, the roller cover support defining a bearing receiving space substantially enclosing the bearing and configured to prevent removal of the roller cover support from the bearing in the inboard and outboard directions, wherein the roller cover support comprises first and second interconnected hub portions defining the bearing receiving space, the first hub portion having an inner surface juxtaposed to a first radial bearing surface of the bearing and the second hub portion having an inner surface juxtaposed to a second radial bearing surface of the bearing;

a paint roller cover for placing on the roller cover support; and a cover-gripping element disposed in an annular space defined between the first and second hub portions, the cover-gripping element configured to frictionally retain the roller cover on the cover support.

31. A paint roller support for supporting a roller cover, comprising:

an elongated shaft; and a roller-cover grabbing mechanism rotatably coupled to the shaft, the grabbing mechanism comprising a non-circular split ring configured to contact an inside surface of the roller cover at a plurality of angularly spaced locations, the ring exerting a retaining force against the inside surface of the roller cover at the angularly spaced locations, thereby retaining the roller cover on the shaft.

32. The paint roller support of claim 31, further comprising:

an inboard bearing and an outboard bearing disposed on the shaft; and an inboard end cap and an outboard end cap rotatably supported on the inboard and outboard bearings, respectively, the inboard and outboard end caps being freely rotatable about the inboard and outboard bearings, respectively, and one of the inboard and the outboard end caps retaining the roller-cover grabbing mechanism.

33. The paint roller support of claim 32, wherein the shaft has an inboard and an outboard raised surface portion for frictionally retaining the inboard and outboard bearings, respectively, against rotational movement relative to the shaft.

34. The paint roller support of claim 33, wherein the raised surface portions are embossed surface portions.

35. The paint roller support of claim 31, wherein the split ring is formed from a bent wire.

36. A paint roller support for supporting a roller cover, comprising:

an elongated shaft; and a roller-cover grabbing mechanism rotatably coupled to the shaft and configured to exert a retaining force against an inside surface of the roller cover, the retaining force deforming the inside surface of the roller cover, thereby retaining the roller cover on the shaft;

wherein the grabbing mechanism comprises a locking spring;

wherein the locking spring has a plurality of generally straight sides and vertices between adjacent sides contacting the inner surface of the roller cover.

37. The paint roller support of claim 36, wherein the locking spring is hexagonal.

38. A paint roller support, comprising:

an elongated shaft;

a bearing mounted on the shaft, the bearing comprising a central portion and opposite end portions that are smaller in diameter than the central portion;

a roller-cover retaining element exerting a retaining force against an inside surface of a roller cover for frictionally retaining the roller cover on the paint roller support during use; and at least one cover support rotatably coupled to the bearing for supporting a roller cover, the cover support defining a retaining-element receiving space in which the retaining element is disposed, the receiving space being dimensioned to permit limited radial and axial movement of the retaining element and limited axial movement of the roller cover relative to the shaft when the roller cover is retained by the retaining element, the cover support also comprising an axially extending bearing-receiving space in which the bearing is disposed, the cover support having circumferentially extending, axially spaced-apart, first and second inner surfaces that rotate on the opposite end portions of the bearing.

39. The paint roller support of claim 38, wherein the bearing-receiving space is dimensioned to permit radial and axial movement of the cover support relative to the bearing but prevent removal of the cover support from the bearing.

40. A paint roller support assembly comprising:

a frame having an elongated roller portion and a lower end portion;

a handle coupled to the lower end portion of the frame;

at least one cover support for supporting a roller cover, the cover support being rotatably coupled to the roller portion of the frame; and a locking spring rotatably coupled to the roller portion, the locking spring comprising a generally ring-shaped, open band exerting a retaining force against an inner surface of the roller cover for frictionally retaining the roller cover on the support during use, wherein the band has a plurality of generally straight sides and vertices between adjacent sides such that the band exerts the retaining force against the inner surface of the roller cover at the vertices.

41. A paint roller support for supporting a paint roller cover, composing:

a frame having an elongated shaft, the shaft having inboard and outboard embossed surface portions, the outboard embossed surface portion having a first diameter, the inboard embossed surface portion having a second diameter, the first diameter being smaller than the second diameter;

an inboard bearing frictionally engaging the inboard embossed surface portion such that the inboard bearing is retained from rotating relative to the shaft;

an outboard bearing frictionally engaging the outboard embossed surface portion such that the outboard bearing is retained from rotating relative to the shaft, the outboard bearing having a closed end wall adjacent an outboard end of the shaft;

a locking spring configured to exert a radially outwardly directed biasing force against an inside surface of the roller cover for frictionally retaining the roller cover in place while the paint roller support is used to deliver paint to a surface, the locking spring being polygonal in shape with vertices that contact and deform the inside surface of the roller cover;

an inboard cover support rotatably supported on the inboard bearing, the inboard cover support comprising a first portion having a longitudinally extending sleeve and a second portion having a longitudinally extending sleeve, the sleeves at least partially overlapping each other and forming a snap fit with each other, the inboard cover support defining a locking-spring receiving space between the first and second portions, the locking spring being disposed in the receiving space, the receiving space being dimensioned to permit axial and radial movement of the locking spring relative to the inboard cover support;

an outboard cover support rotatably supported on the outboard bearing, the outboard cover support having a closed end wall adjacent the end wall of the outboard bearing, the outboard cover support comprising a first portion having a longitudinally extending sleeve and a second portion having a longitudinally extending sleeve, the sleeves at least partially overlapping each other and forming a snap fit with each other, the inboard and outboard cover supports dimensioned to support the paint roller cover during use;

a swedge formed on the shaft inboard of the inboard cover support; and a washer disposed on the shaft and positioned between the swedge and the inboard cover support.

* * * * *